US006292345B1

(12) United States Patent
Müller et al.

(10) Patent No.: US 6,292,345 B1
(45) Date of Patent: Sep. 18, 2001

(54) METHOD FOR CONTROLLING AN ELECTROMECHANICAL ACTUATOR

(75) Inventors: Nikolaus Müller, Regensburg; Achim Koch, Tegernheim, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/538,141

(22) Filed: Mar. 29, 2000

Related U.S. Application Data

(63) Continuation of application No. PCT/DE98/02585, filed on Sep. 2, 1998.

(51) Int. Cl.[7] ..... H01H 50/16
(52) U.S. Cl. ..... 361/160; 361/206
(58) Field of Search ..... 361/152–154, 361/159, 160, 170, 187, 206

(56) References Cited

U.S. PATENT DOCUMENTS

| | | | |
|---|---|---|---|
| 4,029,068 | 6/1977 | Jones et al. | 123/139 E |
| 5,650,909 | 7/1997 | Remele et al. | 361/154 |
| 5,818,680 * | 10/1998 | Schmitz et al. | 361/160 |

FOREIGN PATENT DOCUMENTS

| | | | |
|---|---|---|---|
| 195 18 056 A1 | 11/1996 | (DE) | H01F/7/16 |
| 195 26 683 A1 | 1/1997 | (DE) | H01F/7/18 |
| 196 05 974 A1 | 8/1997 | (DE) | H01H/47/22 |
| 0 376 716 | 7/1990 | (EP) | F01L/9/04 |
| 0 566 281 A1 | 10/1993 | (EP) | F02D/41/16 |
| 0 662 697 A1 | 7/1995 | (EP) | H01F/7/18 |
| 0 724 067 A1 | 7/1996 | (EP) | F01L/9/04 |

OTHER PUBLICATIONS

Japanese Patent Abstract No. 02291412 (Hideo), dated Dec. 3, 1990.

* cited by examiner

*Primary Examiner*—Ronald W. Leja
(74) *Attorney, Agent, or Firm*—Herbert L. Lerner; Laurence A. Greenberg; Werner H. Stemer

(57) ABSTRACT

A method for controlling an electromechanical actuator includes providing an actuator having an actuating element and an actuating drive. The actuating drive has at least one electromagnet with a coil, a movable armature plate, a regulator having current through the coil as a controlled variable, and at least one resetter prestressing the armature plate into a predetermined rest position with the actuating drive. A first capture value is predetermined as a set value of the current through the first or second coil. A second capture value is predetermined as a set value when a first condition is satisfied. A holding value (I_H) is predetermined as a set value when a second condition is satisfied. The second capture value is greater than the holding value.

9 Claims, 5 Drawing Sheets

METHOD FOR CONTROLLING AN ELECTROMECHANICAL ACTUATOR

CROSS-REFERENCE TO RELATED APPLICATION

This is a continuation of copending International Application PCT/DE98/02585, filed Sep. 2, 1998, which designated the United States.

BACKGROUND OF THE INVENTION

Field of the Invention

The invention relates to a method for controlling an electromechanical actuator, in particular, to an actuator for controlling an internal combustion engine.

An actuator is described in German Published, Non-Prosecuted Patent Application 195 26 683A1 corresponding to U.S. Pat. No. 5,691,680 to Schrey et al. The actuator has an actuating element in the form of an inlet and/or outlet valve, and an actuating drive. The actuating drive has two electromagnets between which, and, in each case against the force of a resetter, an armature plate can be moved by switching off the coil current to the holding electromagnet and switching on the coil current to the capturing electromagnet. The coil current to the respective capturing electromagnet is kept constant at a predetermined capture value I_MAX for a predetermined time period, is then switched off for a predetermined switched-off time, and is then regulated at a holding value by a two-point regulator with hysteresis. The time response of the coil current during the switched-off time is used to identify bouncing of the armature plate against the respective electromagnet, and to correct the capture value appropriately. However, the coil current cannot be set to the corrected capture value until the next capture process. Thus, the armature plate may move so far away from the capturing electromagnet during the switched-off time that the holding current can no longer apply sufficient force to move the armature plate into contact with the capturing electromagnet.

Another actuator is described in U.S. Pat. No. 5,650,909 to Remele et al. The actuator has an actuating element in the form of an injection valve, and an actuating drive. The actuating drive has an electromagnet, an armature, and a resetter. When current flows through a coil of the electromagnet, the armature plate can be moved against the force of the resetter into contact with the electromagnet. The actuating drive has an associated regulator, whose controlled variable is the current through the coil of the electromagnet. In order to move the armature from a first position to make contact with the electromagnet, a maximum value is predetermined as a set value of the current through the coil until the armature starts to move. An opening value is then predetermined as the set value, which is less than the maximum value. When the armature is in contact with the electromagnet, a holding value is predetermined as the set value, which is less than the opening value. Choosing the opening value to be low, as is advantageous in order to keep the power consumption low, may lead to the armature plate dropping and not coming into contact with the electromagnet.

European published, non-prosecuted patent application no. EP 07 24 067 A1, corresponding to U.S. Pat. No. 5,752,478 to Sono et al. and U.S. Pat. No. 5,765,514 to Sono et al., discloses another actuator having an actuating element in the form of an inlet and/or outlet valve. A position sensor is provided to detect the position of the inlet and/or outlet valve.

SUMMARY OF THE INVENTION

It is accordingly an object of the invention to provide a method for controlling an electromechanical actuator that overcomes the hereinafore-mentioned disadvantages of the heretofore-known devices and methods of this general type and that is simple and ensures capture of the armature plate.

With the foregoing and other objects in view, there is provided, in accordance with the invention, a method for controlling an electromechanical actuator, including providing an actuator having an actuating element and an actuating drive, the actuating drive having at least one electromagnet with a coil, a movable armature plate, a regulator having current through the coil as a controlled variable, and at least one resetter prestressing the armature plate into a predetermined rest position with the actuating drive, predetermining a first capture value as a set value of the current through the coil, defining a holding value, predetermining a second capture value as a set value when a predetermined first condition is satisfied, the second capture value being greater than the holding value, and predetermining the holding value as a set value when a predetermined second condition is satisfied.

The solution of the invention has the advantage that the capture value can be predetermined to produce a desired speed profile for the armature plate, and such that the second capture value can be set to ensure reliable capture of the armature, thus preventing the armature from dropping into a rest position.

In accordance with another mode of the invention, a position sensor is provided for determining a position of the armature plate and the predetermined first condition is satisfied when a magnitude of the position of the armature plate exceeds a predetermined threshold value.

In accordance with a further mode of the invention, the second capture value is a function of a speed of the armature plate before the predetermined threshold value was exceeded.

In one preferred refinement of the invention, the second capture value depends on the speed of the armature plate before the threshold value is exceeded. The dependency has the advantage that the second capture value can be predetermined, on one hand, to achieve low heat losses and, on the other hand, to reliably capture the armature plate.

In accordance with an added mode of the invention, the second capture value is defined to be greater than the first capture value.

In accordance with an additional mode of the invention, the predetermined first condition is satisfied when the magnitude of the position of the armature plate exceeds a further threshold value that is longer than a predetermined time period, and a magnitude of the further threshold value is defined to be less than a magnitude of the predetermined threshold value.

In a further advantageous refinement of the invention, the second capture value is predetermined as a set value when the position of the armature plate exceeds a further threshold value whose magnitude is less than the threshold value K0, K5, for longer than a predetermined further time period. The predetermining ensures that the armature plate is reliably captured when the force caused by the first capture value is not sufficient for the position of the armature plate to exceed the threshold value K0, K5.

In accordance with yet another mode of the invention, the second condition is satisfied when a further time period is predetermined as a set value for the second capture value.

In accordance with yet a further mode of the invention, the further time period is a function of a speed of the armature plate before the predetermined threshold value was exceeded.

In accordance with a concomitant mode of the invention, the first capture value is corrected as a function of a speed of the armature plate before the predetermined threshold value was exceeded.

Other features that are considered as characteristic for the invention are set forth in the appended claims.

Although the invention is illustrated and described herein as embodied in a method for controlling an electromechanical actuator, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
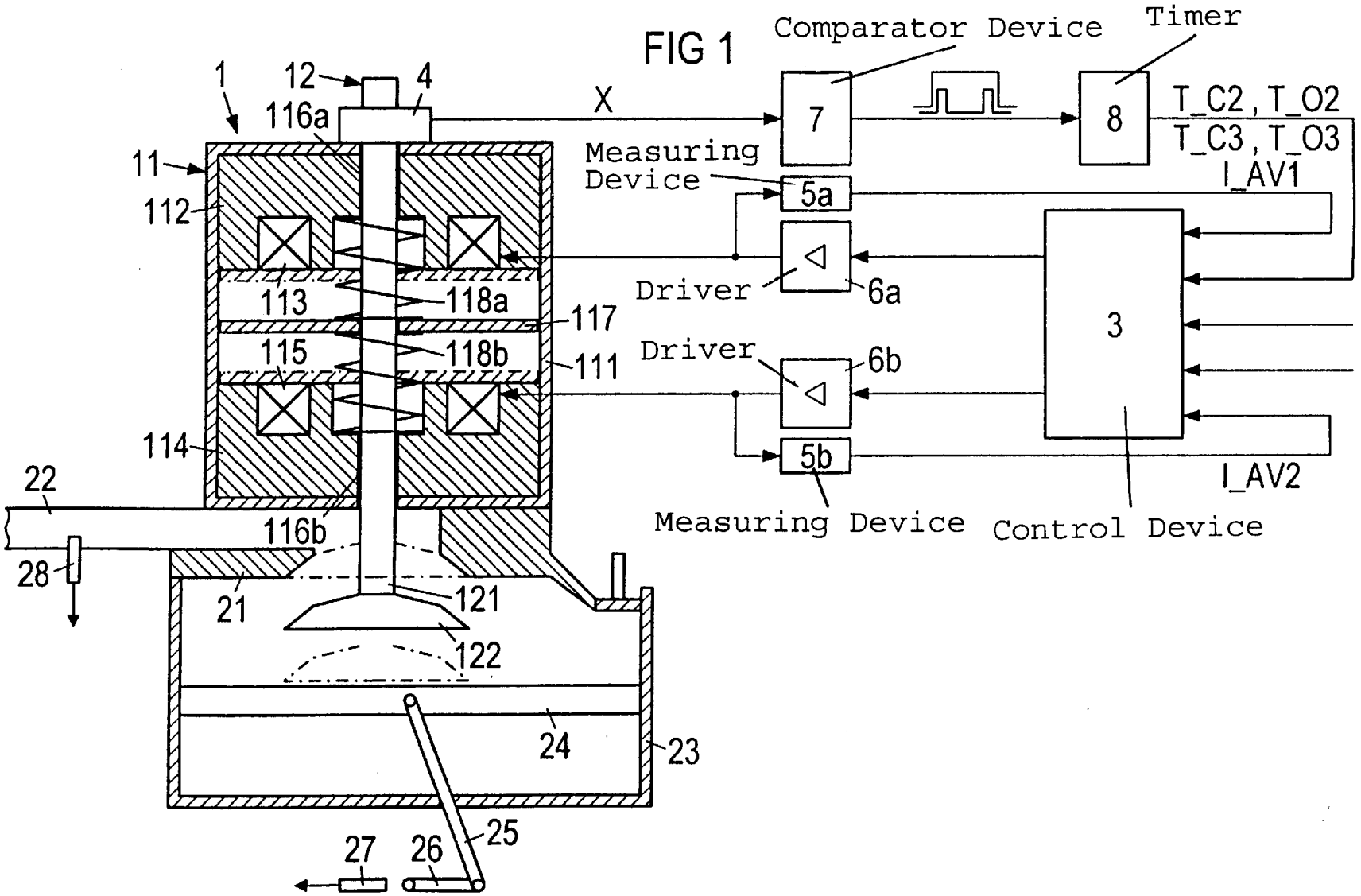
FIG. 1 is a partial diagrammatic, cross-sectional view and partial block circuit diagram of a configuration with an actuator in an internal combustion engine according to the invention.

In all the figures of the drawing, sub-features and integral parts that correspond to one another bear the same reference symbol in each case.

Referring now to the figures of the drawings in detail and first, particularly to FIG. 1 thereof, there is shown an actuator 1 having an actuating drive 11 and an actuating element 12 that is, for example, in the form of an inlet and/or outlet valve and has a stem 121 and a disk 122. The actuating drive 11 has a housing 111 including a first and a second electromagnet. The first electromagnet has a first core 112 and a first coil 113 embedded therein within an annular groove. The second electromagnet has a second core 114 and a second coil 115 embedded therein within a further annular groove. The first core 112 has a recess 116*a* forming a guide for the stem 121. The second core 114 has a further recess 116*b*, which also acts as a guide for the stem 121. An armature plate 117 is movably disposed in the housing 111 between the first core 112 and the second core 114. A first spring 118*a* and a second spring 118*b* prestress the armature plate into a predetermined rest position R.

The actuator 1 is rigidly connected to a cylinder head 21. The cylinder head 21 has an associated induction channel 22 and a cylinder 23 with a piston 24. The piston 24 is coupled to a crankshaft 26 through a connecting rod 25.

A control device 3 detects the signals from sensors and produces actuating signals for the actuator. The sensors may include a position sensor 4 that detects a position X of the armature plate 117, a first current measuring device 5*a* that detects the actual value I_AV1 of the current through the first coil 113, a second current measuring device 5*b* that detects an actual value I_AV2 of the current through the second coil 115, a rotation-speed sensor 27 that detects the rotation speed N of the crankshaft, or a load detection sensor 28 that preferably is an air mass measuring device or a pressure sensor. Further sensors may also be provided in addition to the sensors mentioned.

In the exemplary embodiment according to FIG. 1, a comparator device 7 produces a pulsed signal depending on the detected position X and predetermined threshold values. The function of the comparator device 7 will be explained in more detail below with regard to FIG. 2. A timer 8, preferably, a "CAPCOM" unit, detects the pulse durations of the pulsed signal produced by the comparator device 7 and passes on the time periods T_C2, T_O2, T_C3, T_O3 associated with the pulse durations as digital data to the control device 3.

Drivers 6*a*, 6*b* are provided to amplify the actuating signals of the control device 3.

Figure 2A:
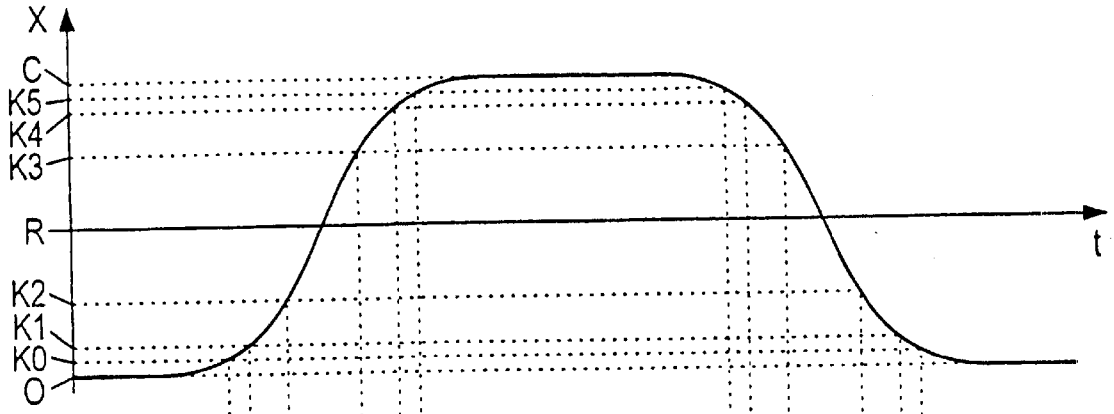
FIGS. 2*a*, 2*b*, and 2*c* are graphs showing the position of the armature plate and output signals from a comparator device plotted against the time t according to the invention.
Figure 2B:
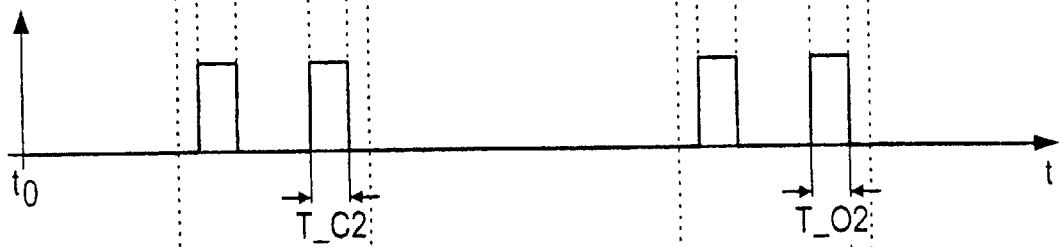
Figure 2C:
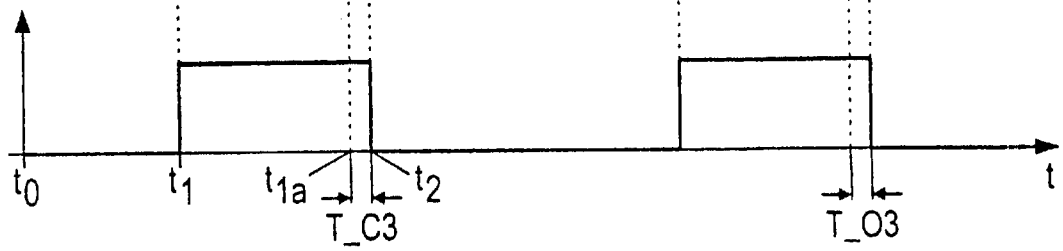

FIG. 2*a* shows the time profile of the position X of the armature plate 117. The comparator device 7 has six analog threshold-value comparators, whose respective output signals are changed at one of the threshold values K0, K1, K2, K3, K4, K5. FIGS. 2*b* and 2*c* show the comparator device pulsed signals that are produced by logic operations in the threshold-value comparators. The threshold values K0, K1, K2 are predetermined to be at the same distance from the rest position R of the armature plate as the threshold values K3, K4 and K5, respectively. The threshold values are, for example, at the following relative intervals, which are related to the distance between the contact surface of the armature plate with the first electromagnet and the contact surface of the armature plate with the second electromagnet: K0 at 2%, K1 at 5%, K2 at 20%, K3 at 80%, K4 at 95% and K5 at 98%.

The timer 8 determines the pulse durations of the pulses in the pulsed signals. The pulse duration of the pulses, which is predetermined by the threshold values K3 and K4, is associated with the time period T_C2. To a first approximation, the time period T_C2 is a measure of the mean speed of the armature between the threshold values K3 and K4. In the same way, the timer determines the time period T_C3, which is predetermined by the interval between the times at which the position X exceeds the threshold values K4 and K5. The time periods T_O2 and T_O3 are determined in an analogous manner to the determination of the time periods T_C2 and T_C3.

Figure 3:
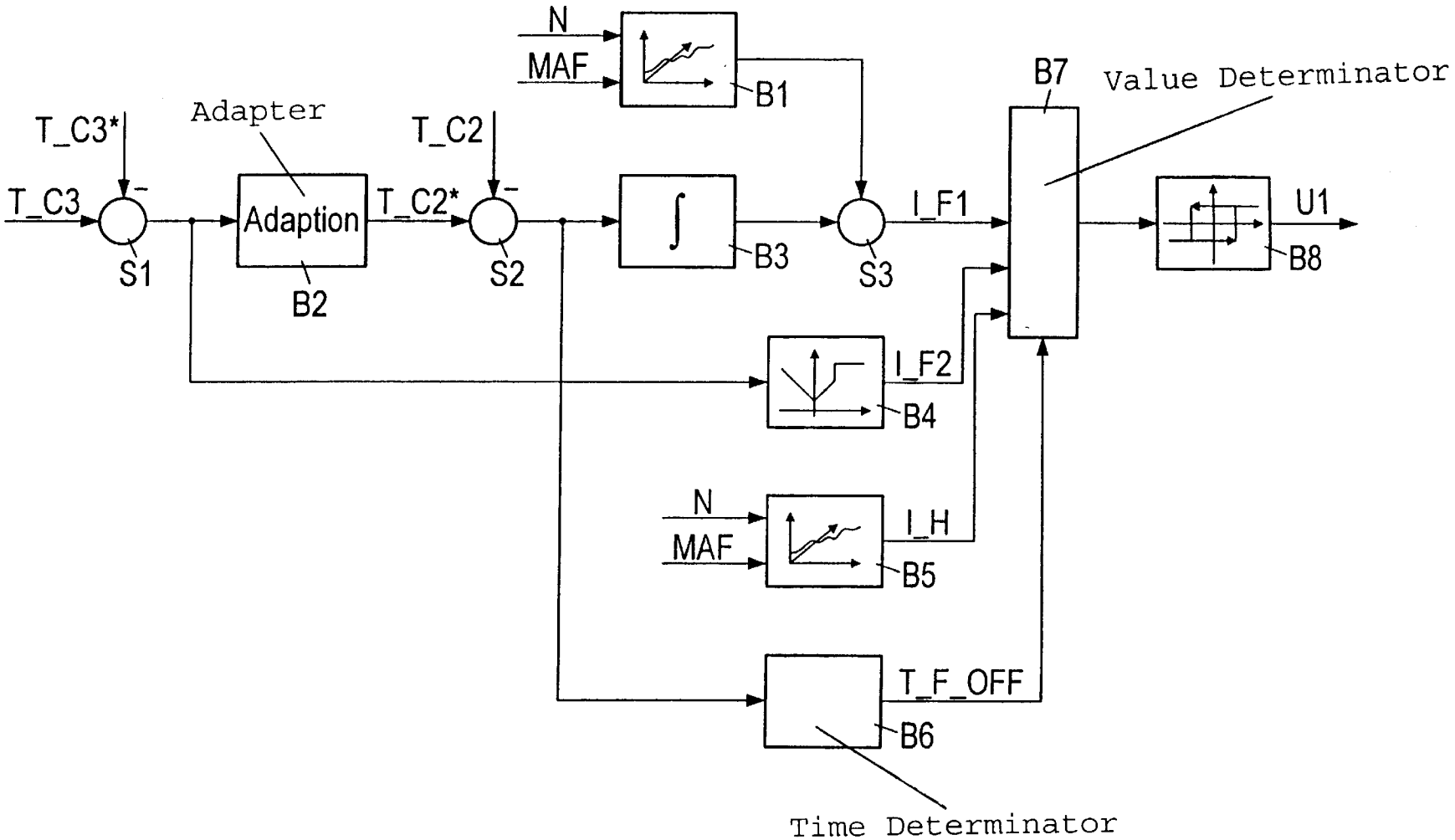
FIG. 3 is a block circuit diagram of a control device for controlling the actuator of FIG. 1 according to the invention.

FIG. 3 shows a block diagram of the control device 3 for controlling the electromechanical actuator 1. A first capture value I_F1 is determined in a block B1 from a family of characteristics, to be precise as a function of the rotation speed N and the air mass flow MAF. The values in the family of characteristics are determined on an engine test device or by simulations, so that heat losses in the respective coil are low.

The difference between an actual time period T_C3 and the set value T_C3* of the time period is determined at an addition point S1. A predetermined set value T_C2* is then adapted in a block B2, depending on the difference that has been determined at the addition point S1. The difference between the set value T_C2* and the actual time period T_C2is calculated at an addition point S2.

A block B3 has an integrator that calculates a correction value depending on the difference between the set value T_C2* and the actual time period T_C2, and is used to correct the first capture value I_F1 at the third addition point S3.

A second capture value I_F2 is determined in a block B4. The second capture value I_F2 is either predetermined to be fixed or is defined in a characteristic depending on the difference between the actual time period T_C3 and the set value T_C3* of the time period. If the second capture value I_F2 is predetermined to be fixed, then an advantage is provided in that the second capture value I_F2 can be determined with less computation. If the second capture value I_F2 is determined through the characteristic depending on the difference between the actual time period T_C3 and the set value T_C3* of the time period, then a considerable reduction of the heat losses from the respective coil through which the current is passing results.

Figure 5:
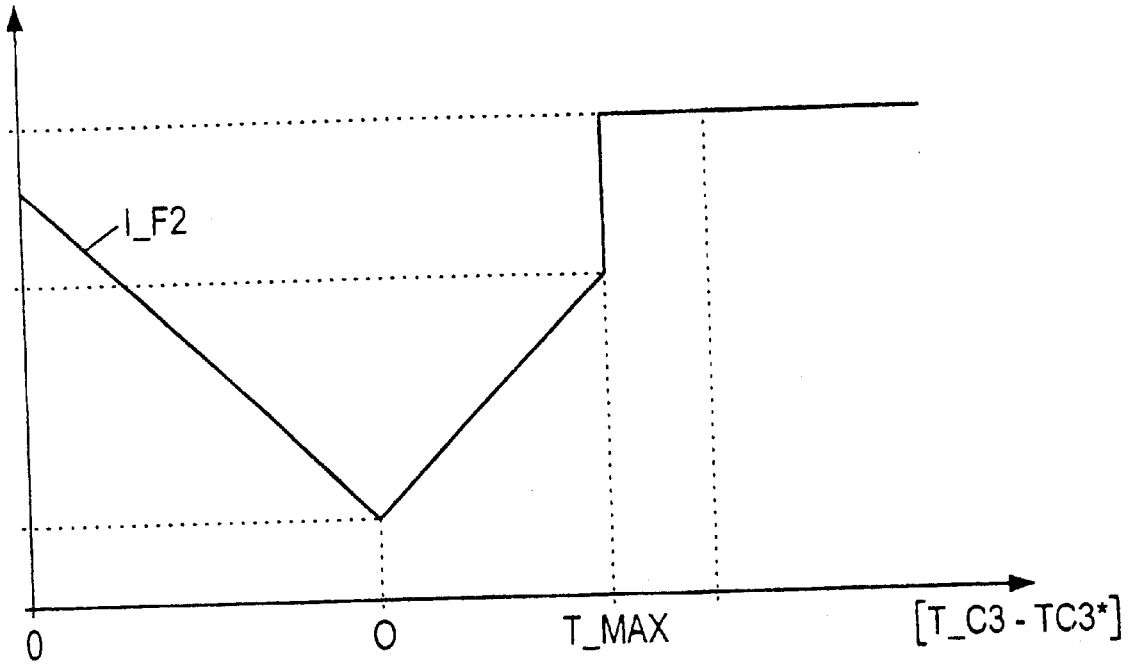
FIG. 5 is a graph showing a characteristic of a second capture value according to the invention.

The characteristic is preferably in the form shown in FIG. 5. If the difference between the actual time period T_C3 and the set value T_C3* of the time period is equal to zero, then the second capture value I_F2 is at a minimum value. If the difference is less than zero, then the second capture value I_F2 rises in order to produce a sufficient force to damp any bouncing process and to prevent the armature from dropping into the rest position as a result of the bouncing. If the difference is greater than zero, then the second capture value is also increased, in order to avoid the armature plate dropping into the rest position R.

A holding value I_H is determined from a family of characteristics in a block B5, depending on the rotation speed N and an air mass flow MAF. A time period T_F_OFF is determined in a block B6, to be precise depending on the difference between the set value T_C2* and the actual time period T_C2.

Depending on the position of the armature plate, the time period T_MAX, the time period T_F_OFF, and further internal combustion engine operating parameters, a block B7 determines whether the set value for a regulator B8 is the first capture value I_F1, the second capture value I_F2, the holding value I_H, or a zero value. The position X of the armature plate is determined indirectly through the actual time periods T_C2, T_C3, T_O2, T_O3.

As soon as a predetermined first condition is satisfied, the set value for the regulator B8 changes from the first capture value I_F1 to the second capture value I_F2. The first condition is preferably satisfied when the magnitude of the position X of the armature plate exceeds the threshold value K5, K0, which is identified indirectly by the timer 8 passing on a new actual time period T_C3 to the control device 3.

The controlled variable of the regulator B8 is the current through the respective coil 113, 115, through which current passes. The difference between the set value determined in the block B7 and the actual current I_AV1, I_AV2 through the coil 113, 115 is the control difference of the regulator B8. The regulator is preferably a two-point regulator with hysteresis. The manipulated variable of the regulator is a voltage signal U1, U2 that is supplied respectively to the drivers 6*a*, 6*b* that amplify the signal and supply the signal to the first and second coil 113, 115, respectively.

By way of example, FIG. 3 shows the block diagram for calculating the actuating signal for the first coil 113. The actuating signal for the second coil 115 is calculated analogously, with the time periods T_C2 and T_C3 just being replaced by the time periods T_O2 and T_O3.

Figure 4A:
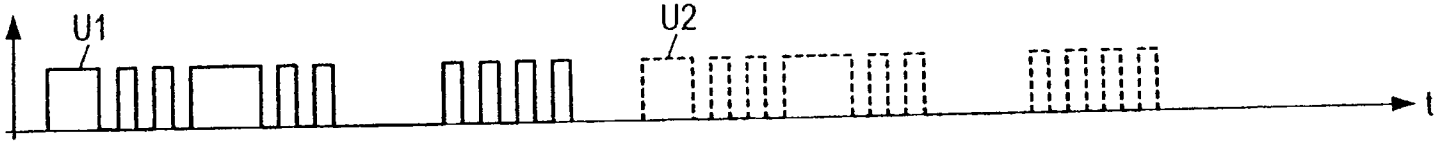
FIGS. 4*a*, 4*b*, and 4*c* are graphs showing the time profile of the voltages and the current through the first coil and the second coil, and the position of the armature plate according to the invention.

FIG. 4*a* shows the manipulated variable of the regulator B8, which is a first voltage signal U1 used to energize the first coil 113, or a second voltage signal U2 used to energize the second coil 115.

Figure 4B:
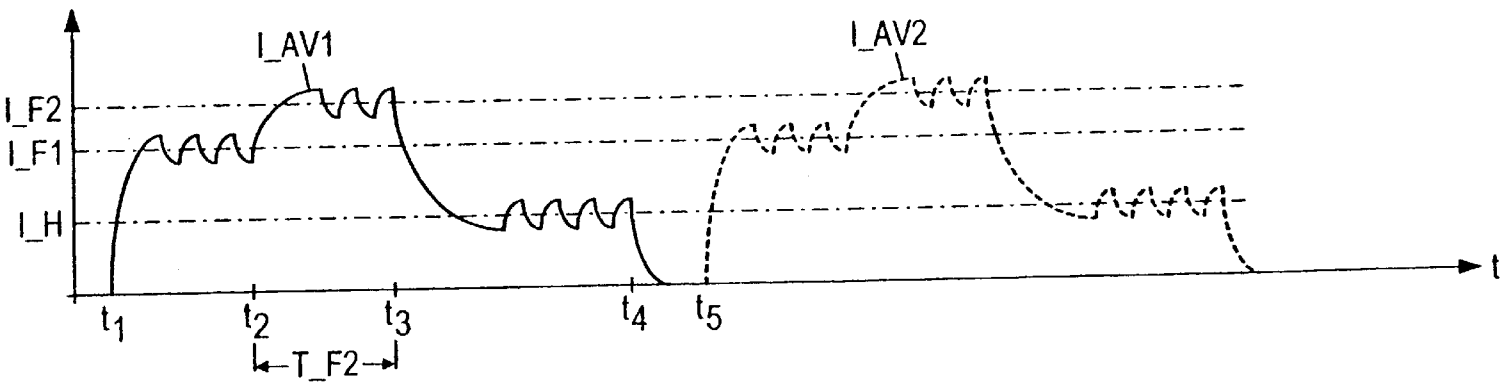

FIG. 4*b* shows the associated time profile of the actual value I_AV1 of the current through the first coil 113 and, with the dotted line, the time profile of the actual value I_AV2 of the current through the second coil 115.

Figure 4C:
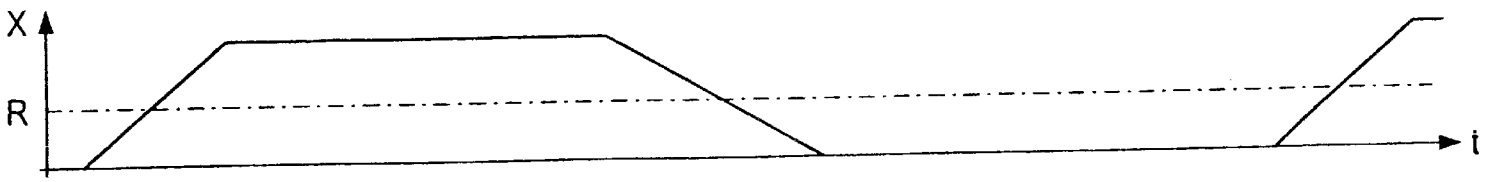

FIG. 4*c* shows the position X of the armature plate plotted against time t.

From a time $t_1$, to a time $t_2$, the set value for the current through the first coil 113 is the first capture value I_F1. At the time $t_2$, which preferably occurs shortly before the armature plate 117 is expected to arrive at the first core 112, the second capture value I_F2 is then predetermined as the set value for the regulator B8. For the time period T_F2, the set value of the regulator B8 is the second capture value. A second condition is satisfied when the time period from the presetting of the second capture value I_F2 is greater than the time period T_F2. Particularly high reliability for controlling the actuating element, with simultaneous low heat losses, are ensured if the time period T_F2 depends on the speed of the armature plate 117 before the threshold value K5was exceeded. The time period T_C3 is a measure of the speed of the armature plate before the threshold value K5 was exceeded. The second capture value I_F2 is advantageously chosen to be greater than the first capture value I_F1. This ensures that the armature plate is reliably captured by the first electromagnet.

As soon as the second condition is satisfied—the situation at time $t_3$—the holding value I_H is predetermined as the set value for the regulator B8 until a time $t_4$. The holding value may be chosen to be very low and, particularly, less than the second capture value I_F2, because the armature is resting statically against the first electromagnet when the holding value I_H is the set value for the regulator B8.

The value zero (for example zero amperes) is predetermined as the set value for the current through the first coil 113 from the time $t_4$. The armature plate then moves in the direction of the second electromagnet. To have the second electromagnet capture the coil, current then flows through the second coil from the time $t_5$, particularly, when the first capture value I_F1 is predetermined as the set value for the regulator B8, so that the regulator B8 then produces the second voltage signal U2.

The invention is not limited to the described exemplary embodiment. For example, the actuating element may also be an injection valve. The method may also be implemented as a microprocessor program. The method may likewise be implemented by a logic circuit or an analog circuit configuration.

The regulator may also be, for example, a single-point regulator with a timer, or a pulse-width-modulation regulator. One regulator may also be provided for each coil 113, 115.

Alternatively, a rectifier may also be provided, which rectifies the signal from the position sensor 4, with the rest position R then having the value zero. Accordingly, the comparator device then has only three threshold-value comparators, whose respective output signals are changed at the threshold values K0, K1 and K3, respectively.

The predetermination of the holding value as the set value for the current through the first coil may also be carried out after a predetermined time period from the time at which the value zero was predetermined as the set value for the current through the second coil.

The armature plate strikes the respective core 112, 114 at a particularly low speed if the first capture value I_F1 is set to the value zero for the time period T_F_OFF after a time $t_{1a}$. The time period T_F_OFF is calculated in the block B6 as a function of the difference between the set value T_C2* and the actual time period T_C2. Because the difference between the actual time period T_C2 and the set value T_C2* is a measure of the discrepancy from the expected striking speed, the speed at which the armature strikes the core can be set to the desired value by switching off the current through the coil for the time period T_F_OFF.

We claim:

1. A method for controlling an electromechanical actuator, which comprises:

providing an actuator having an actuating element and an actuating drive, the actuating drive having at least one electromagnet with a coil, a movable armature plate, a regulator outputting a current as a controlled variable in dependence on a control difference between a set value and an actual value of current through the coil, and at least one resetter prestressing the armature plate into a predetermined rest position with the actuating drive;

performing the following consecutive steps while moving the armature plate to the electromagnet:

predetermining a first capture value as the set value of the current through the coil;

predetermining a holding value as the set value when a predetermined second condition is satisfied; and predetermining a second capture value, the second capture value being greater than the holding value in case a predetermined first condition is satisfied.

2. The method according to claim 1, which comprises:

providing a position sensor for determining a position of the armature plate; and satisfying the predetermined first condition when a magnitude of the position of the armature plate exceeds a predetermined threshold value.

3. The method according to claim 2, which comprises relating the second capture value as a function of a speed of the armature plate before the predetermined threshold value was exceeded.

4. The method according to claim 2, which comprises satisfying the predetermined first condition when the magnitude of the position of the armature plate exceeds a further threshold value longer than a predetermined time period, and defining a magnitude of the further threshold value to be less than a magnitude of the predetermined threshold value.

5. The method according to claim 2, which comprises correcting the first capture value as a function of a speed of the armature plate before the predetermined threshold value was exceeded.

6. The method according to claim 1, which comprises defining the second capture value to be greater than the first capture value.

7. The method according to claim 1, wherein the second condition is satisfied when a further time period is predetermined after the set value for the second capture value is predetermined.

8. The method according to claim 7, which comprises relating the further time period as a function of a speed of the armature plate before the predetermined threshold value was exceeded.

9. A method for controlling an electromechanical actuator, which comprises:

providing an actuator having an actuating element and an actuating drive, the actuating drive having at least one electromagnet with a coil, a movable armature plate, a regulator outputting an actuating signal for the coil dependent on a control difference between a set value and an actual value of current through the coil, and at least one resetter prestressing the armature plate into a predetermined rest position with the actuating drive;

performing the following consecutive steps while moving the armature plate to the electromagnet:

setting the set value on a predetermined first capture value;

setting the set value on a predetermined second capture value, when a predetermined first condition is satisfied, the second capture value being greater that the first capture value and a predetermined holding value; and setting the set value on the predetermined holding value when a predetermined second condition is satisfied.

* * * * *